United States Patent [19]

Rials

[11] 4,004,315

[45] Jan. 25, 1977

[54] SUPPORT DEVICE FOR USE WITH A TOWEL OR THE LIKE

[76] Inventor: Elbert O. Rials, 3603 Oakhurst Drive, Midwest City, Okla. 73110

[22] Filed: Jan. 19, 1976

[21] Appl. No.: 650,431

[52] U.S. Cl. ..... 15/209 R; 24/3 K; 24/7; 224/5 B

[51] Int. Cl.[2] ..... A47K 10/12

[58] Field of Search ..... 15/209 R; 24/3 R, 3 H, 24/3 J, 3 L, 3 M, 7, 8, 73 A, 3 K; 118/201; 224/5 A, 5 B, 5 Z; 211/6

[56] References Cited

UNITED STATES PATENTS

| | | | |
|---|---|---|---|
| 184,376 | 11/1876 | Hardy | 24/8 |
| 1,552,156 | 9/1925 | Heller | 24/3 K |
| 1,620,904 | 3/1927 | Lewis et al. | 24/31 X |
| 2,694,844 | 11/1954 | Grumbach | 24/3 K UX |
| 2,754,532 | 7/1956 | Kanehl et al. | 15/209 R |
| 3,040,357 | 6/1962 | Belleni | 15/209 R |

*Primary Examiner*—Daniel Blum
*Attorney, Agent, or Firm*—William R. Laney

[57] ABSTRACT

A support device for use with a towel or the like comprising a relatively rigid panel member, having an enlarged first end connected by a tapered mid-section to a narrow end of reduced thickness. A relatively flexible neck portion has a first end connected to the narrow end of the panel member, and has an aperture formed therein. A spring hook is received through the aperture to detachably retain a towel or the like on the panel member.

10 Claims, 7 Drawing Figures

SUPPORT DEVICE FOR USE WITH A TOWEL OR THE LIKE

BACKGROUND OF THE INVENTION

1. Field of the Invention

This invention relates to a support device for a towel or the like, which device can be quickly and easily inserted in the pocket or waistband of an individual's clothing, or between the belt and waistband thereof, or within the collar while the towel or the like hangs free and is readily accessible.

2. Description of the Prior Art

A number of devices have previously been proposed which are intended to permit a towel or similar article upon which the hands may be wiped to dry or clean them to be carried on the person of the user in a way which does not interfere with the functioning of the person in other activities, and yet renders the towel readily accessible. Such devices have included spring clips by which the towel can be clipped to either the belt or one of the belt loops of the apparel of the user, and rigid, hook-shaped members which can be inserted in a pocket to suspend the towel outside the pocket where it is within each reach. The latter types of devices frequently have been shaped so that they can be fitted in a particular pocket in the trousers or coat or shirt of the user, and, in order to prevent the holding structure from inadvertently coming out of the pocket, have included a clamping element or clip which bears against and frictionally engages a portion of the clothing which defines the pocket. Devices of this type are frequently difficult to remove quickly from the pocket, and must be removed with care to prevent snagging or tearing the pocket. Moreover, such devices often can only be placed in a pocket of the user's apparel and often, insertion in a particular or specific pocket is even required in the use of the device.

Examples of towel holding structures of the type described are those which are illustrated in U.S. Pats. Nos. 3,040,357; 2,862,219; 2,754,532 and 255,620.

SUMMARY OF THE INVENTION

The present invention contemplates a support device for use with a towel or the like. The device includes a relatively rigid panel member having first and second ends interconnected by a tapering mid-section. The device further includes a relatively flexible member having a first end portion and a second end portion with the first end portion thereof being connected to the second end portion of the panel member and preferably formed integrally with the panel member. Hook means for connecting the support device with a towel or the like is connected to the relatively flexible member to facilitate freedom of movement of the towel in relation to the panel member.

The geometric configuration of the support device of the present invention is unique in a device of its type, and is especially conceived to permit the least difficulty in inserting the support device into the user's clothing to a position of retention, is configured for maximum flexibility and versatility in the various places where the support device can be disposed in the apparel of the user to provide firm retention for the towel which it supports, and is shaped so that the maximum weight and center of gravity of the device is always well down in the pocket, or within the apparel, of the user when it is placed in its supporting position, and thus is not easily or inadvertently lost from the apparel or clothing of the user.

An object of the invention is to provide a support device for a towel or the like which is convenient to use.

Another object of the invention is to provide a support device for use with a towel or the like which can be conveniently secured to and removed from the person of an individual.

A further object of the invention is to provide a towel assembly including a support device and a towel releasably securable thereto which can be conveniently secured to and removed from the person of an individual.

A still further object of the invention is to provide a support device for use with a towel or the like which is inexpensive to construct and reliable in operation.

Yet another object of the invention is to provide a support device for supporting a towel in an exposed position where it can be reached by an athlete, hunter, or other user of the device, which support device is configured to permit it to be quickly and easily inserted in a pocket, in a collar, in a waistband or within the belt or shirt pocket of a user with practically no difficulty arising in its use as a result of obstruction or frictional resistance to the placement of the device in its supporting position.

Other objects and advantages of the invention will be evident from the following detailed description when read in conjunction with the accompanying drawing.

DESCRIPTION OF THE PREFERRED EMBODIMENT

Figure 1:
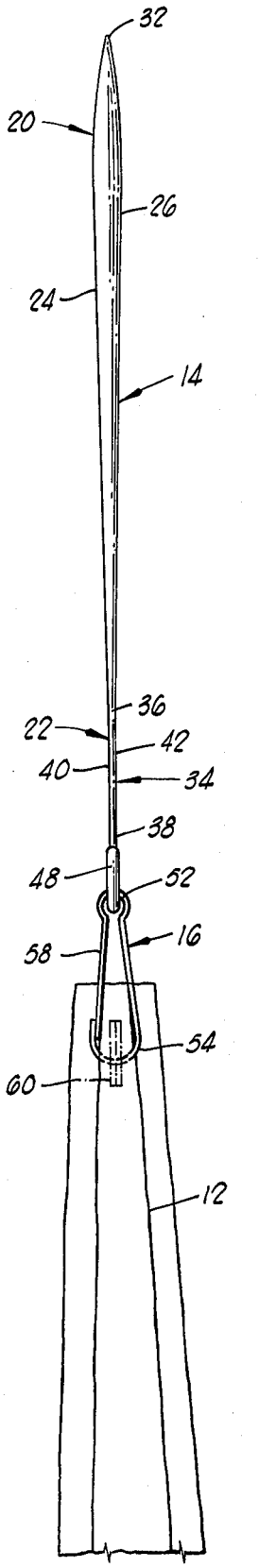
FIG. 1 is an elevational view of one edge of a support device constructed in accordance with the present invention, showing the device engaged with a towel. A part of the towel is broken away to facilitate illustration.
Figure 2:
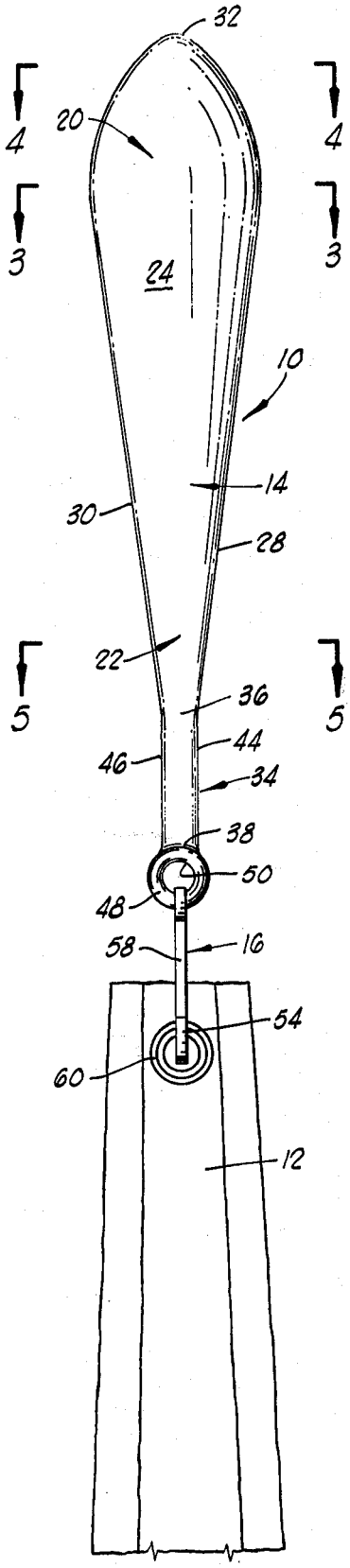
FIG. 2 is an elevational view of one side of the support device of FIG. 1. Again, a portion of the towel is broken away.
Figure 3:
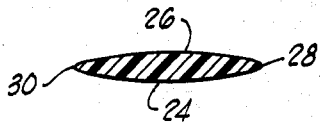
FIG. 3 is a sectional view taken along line 3—3 of FIG. 2.
Figure 4:
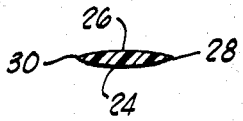
FIG. 4 is a sectional view taken along line 4—4 of FIG. 2.
Figure 5:
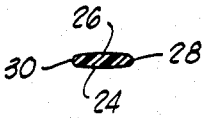
FIG. 5 is a sectional view taken along line 5–5 of FIG. 2.
Figure 6:
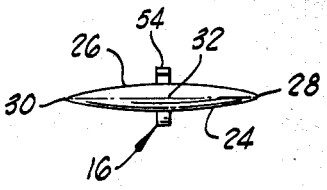
FIG. 6 is a top plan view of one end of the support device omitting the towel.
Figure 7:
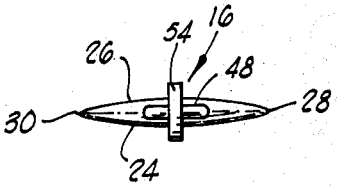
FIG. 7 is a bottom plan view of the opposite end of the support device, omitting the towel.

Referring now to the drawing, a support device for use with a towel or the like and constructed in accordance with the present invention is generally designated by the reference character 10. The support device is shown in FIGS. 1 and 2 secured to one side or corner of a towel 12.

The support device 10 comprises a support member 14 and a spring hook 16 secured thereto.

The support member 14 is preferably formed of a unitary molded mass of plastic or synthetic resinous material. A preferred material of construction of the support member 14 is polypropylene.

The support member 14 comprises a relatively rigid panel having a relatively wide and thick first end portion 20 and a relatively narrow and thin second end portion 22. The panel further includes opposite sides 24 and 26 and opposite edges 28 and 30 extending between the first and second end portions 20 and 22. The opposite sides 24 and 26 are each convexly curved and are tapered to converge inwardly from the first end portion 20 to the second end portion 22, as clearly shown in FIG. 1.

The opposite edges 28 and 30 also converge inwardly from the first end portion 20 to the second end portion 22 of the panel as shown in FIG. 2. The opposite edges 28 and 30 are arcuately shaped at the first end portion 20 and meet to form a smoothly, convexly curved first end face 32 on the first end portion 20 of the panel.

The support member 14 further includes a relatively flexible neck portion 34 having first and second end portions 36 and 38, with the first end portion 36 thereof being connected to the relatively narrow second end portion 22 of the panel so that the neck portion 34 extends from the panel along the major axis of the panel. The neck portion 34 further includes substantially parallel opposite sides 40 and 42 and opposite edges 44 and 46.

The opposite sides 24 and 26 at the second end portion 22 of the panel coincide with, and merge smoothly with, the corresponding opposite sides 40 and 42 at the first end portion 36 of the neck portion 34. Similarly, the opposite edges 28 and 30 at the second end portion 22 of the panel coincide with, and merge smoothly with, the corresponding opposite edges 44 and 46 at the first end portion 36 of the neck portion 34. A toroidal shaped enlargement 48 is formed on the second end portion 38 of the neck portion 34 and surrounds an aperture 50 through which an end portion 52 of the spring hook 16 is received to secure the spring hook to the support member 14. The opposite end portion 54 of the spring hook 16 preferably includes a hook 56 formed thereon which is yieldably engaged by a spring metal tang 58 extending from the end portion 52. A towel 12 having a grommet 60 therein is snap-engaged by the spring hook 16.

As will be perceived by referring to FIGS. 2–5, the maximum thickness measured through the panel between the opposite sides 24 and 26 thereof occurs at the first end portion 20 a short distance inwardly from the end face 32, and it will be further observed that this thickness at this point is substantially greater than the thickness between the converged opposite sides 24 and 26 at the second end portion 22 of the panel member, as well as the thickness of the panel member immediately adjacent the first end face 32. Preferably, the thickness between the opposite sides 24 and 26 at the thickest part of the first end portion 20 of the panel member is about three times the thickness between the opposite sides 24 and 26 at the second end portion 22 of the panel member. It will also be noted in FIG. 1 that the opposite sides 24 and 26 converge to a point or line of intersection at the end face 32 of the panel member. As the panel member is shown in the patent drawings, it is portrayed in almost exactly the precise dimensions employed in a preferred embodiment of the invention.

In further referring to the drawings, it will be noticed that the maximum width or transverse dimension between the opposite side edges 28 and 30 at the first end portion 20 of the panel member is several times as great as the transverse dimension or width between these same edges 28 and 30 at the second end portion 22 of the panel member, and also is about the same multiple of the transverse dimension of the neck portion 34.

The thin or reduced cross-sectional area and reduced thickness of the neck portion 34 as compared to the substantially greater cross-sectional area and thickness of the panel at its thickest and widest portion contributes to the ability to achieve flexibility in the neck portion as compared to the relatively rigid character of the panel member. In the preferred construction of the invention in which the support member 14 is molded as a single unitary synthetic resin structure, the preferred material of construction is polypropylene and, when constructed in the depicted dimensions, the neck portion 34 can undergo repeated flexing numerous times without failure or cracking occurring.

In use, the support device 10 is preferably secured to the towel 12 by engaging the spring hook 16 through an aperture preferably in the form of an eyelet or grommet 60 carried by the towel 12, preferably in one corner thereof. The enlarged first end portion 20 of the panel is then inserted into the user's pocket or waistband or between the user's waistband and belt to conveniently enable the user to carry and have access to the towel. The first end portion 20 is inserted downwardly into the pocket or waistband or between the waistband and belt, and the flexible neck portion 34 is permitted to fold back relative to the panel in response to the weight of the towel 12 supported thereby and hanging downwardly.

The geometric configuration of the support member 14 is an important feature of the present invention. By reason of the tapering convergence of the opposite sides 24 and 26 of the panel member at the end face 32, a wedging action can be realized which permits the support member 14 to be easily inserted inside a tight belt or a narrow pocket, or into the top of a boot. The same ease of insertion is facilitated by the convergent taper of the side edges 28 and 30 at that end of the panel member which terminates in the end face 32. It will be further noted that once the thickest portion of the panel member of the support member 14 has passed by the belt or is inside the pocket, the belt tends to clamp the panel member in place by its constriction about a thinner portion of the panel member, such as that portion which is near the second end portion 22 thereof.

Thus, the device cannot be easily lost from the apparel of the user, even should the towel become impaled or hung upon brush as when the user of the device is walking through undergrowth during hunting. The flexible neck portion 34, in facilitating a 90° bend to permit the towel to hang downwardly, keeps the towel readily accessible to the user and further, as a result of such flexibility in the neck portion, permits the towel to be pulled sideways or even lifted upwardly to wipe the back of the neck of the user on particularly hot days, all of which movements can be accomplished without removing the support member 14 from the pocket or belt where the device is carried.

The support device 10, in combination with the towel 12, thus provides a towel assembly which may be conveniently used, for example, by an individual when hunting or participating in various sports, such as golf, tennis or bowling, where it may be deemed advantageous to have a towel conveniently present at all times which may be readily removed from the individual's person, but which resists inadvertent displacement from the individual's person. The enlarged first end portion 20 and tapered opposite sides and opposite edges of the panel of the support member 14 provide resistance to the inadvertent displacement of the support device 10 from the individual's person.

It will be readily apparent that the support device 10 may be used to support items other than, or in addition to, towels. such items, for example, would include keys, hand tools, measuring devices or similar articles which one might desire to conveniently carry on one's person.

From the foregoing it will be seen that the support device of the present invention provides convenient means for carrying a towel or similar article on an individual's person which device is simple in construction, economical to manufacture, convenient to use and reliable in operation. Changes may be made in the combination and arrangement of parts or elements as heretofore set forth in the specification and shown in the drawing without departing from the spirit and scope of the invention as defined in the following claims.

What is claimed is:

1. A support device for accessibly supporting a towel in wearing apparel comprising:

a rigid panel member having a first end portion terminating in a rounded end face and having a second end portion, and having convex arcuate opposite sides and convex arcuate opposite edges extending between the first and second end portions, the opposite sides converging from the first end portion toward the second end portion, and the opposite edges converging from the first end portion toward the second end portion whereby said first end portion is thicker and wider than said second end portion;

a flexible neck portion have first and second end portions, and opposite sides and opposite edges, with the first end portion thereof connected to the second end portion of said panel member whereby said neck portion extends from said panel member;

connector means carried on the second end portion of said neck portion; and hook means secured to said connector means for hooking said support device to a towel.

2. The support device as defined in claim 1 wherein:

the opposite sides of the second end portion of said panel member converge to, and intersect, the opposite sides of the first end portion of said neck portion; and the opposite edges of the second end portion of said panel member converge to, and intersect, the opposite edges of the first end portion of said neck portion.

3. The support device as defined in claim 2 wherein:

the opposite sides of said neck portion are substantially parallel and the perpendicular distance therebetween is about one-third of the maximum perpendicular distance between the opposite sides of said panel member at the thickest portion of said first end portion of said panel member.

4. The support device as defined in claim 2 wherein:

the opposite edges of said panel member are arcuately shaped at the first end portion thereof and intersect to form said rounded end face on the first end portion; and the opposite sides of said panel member converge and intersect at said rounded end face of said panel member.

5. The support device as defined in claim 4 wherein said connector means is characterized further to include:

an aperture formed in the second end portion of said neck portion.

6. The support device as defined in claim 5 wherein said hook means is characterized further to include:

a spring hook clip having opposite ends with one end thereof secured through said aperture and with the opposite end having a hook formed thereon and a spring biased tang yieldably engaging said hook.

7. The support device as defined in claim 5 wherein said panel member and flexible neck portion are an integrally molded unit.

8. The support device as defined in claim 7 characterized further to include:

a toroidal shaped enlargement formed on the second end portion of said neck portion and surrounding said aperture.

9. The support device as defined in claim 8 wherein said panel member is substantially eliptical in transverse cross-section over its length from said rounded end face to said second end portion with the minor axis of the elipse being the maximum distance between said opposite sides and the major axis of the elipse being the distance between said opposite edges.

10. An apparel supportable towel assembly comprising, in combination:

a relatively rigid panel member having a first end portion and a second end portion, said first end portion terminating in a rounded end face, said panel member further having opposite sides of convex arcuate shape in a cross-sectional plane extended transversely across the panel member and convex arcuate configuration in a cross-sectional plane extended longitudinally of the panel member, said opposite sides converging to opposite edges of the panel member, said opposite edges being of convex arcuate configuration and converging to form said rounded end face, and said opposite sides converging toward each other at the opposite end of said panel member from said end face to form a second end terminating the second end portion of said panel member, said first end portion being thicker, as measured along the longest line extending perpendicular to said opposite sides, than is said second end portion as measured along the longest line extending perpendicular to said opposite sides at said second end portion;

a flexible neck portion having a first end portion connected to the second end portion of said panel member and having a second end portion spaced from the first end portion of said neck portion, said flexible neck portion further having opposite sides and opposite edges, said neck portion and panel member being formed as an integral unitary structure of synthetic resin;

a toroidal enlargement on the second end portion of said neck portion and defining a central aperture which extends through the second end portion of said flexible neck portion;

hook means detachably connected through said aperture within said toroidal shaped enlargement; and a towel detachably connected to said clip means.

* * * * *